US008077044B2

(12) United States Patent
Nikitin et al.

(10) Patent No.: US 8,077,044 B2
(45) Date of Patent: Dec. 13, 2011

(54) RFID TAGS WITH ENHANCED RANGE AND BANDWIDTH OBTAINED BY SPATIAL ANTENNA DIVERSITY

(75) Inventors: Pavel Nikitin, Seattle, WA (US); KVS (Venkata Kodukula) Rao, Bothell, WA (US); Sander Lam, Everett, WA (US)

(73) Assignee: Intermec IP Corp., Everett, WA (US)

( * ) Notice: Subject to any disclaimer, the term of this patent is extended or adjusted under 35 U.S.C. 154(b) by 477 days.

(21) Appl. No.: 12/396,361

(22) Filed: Mar. 2, 2009

(65) Prior Publication Data

US 2009/0219158 A1 Sep. 3, 2009

Related U.S. Application Data

(60) Provisional application No. 61/033,313, filed on Mar. 3, 2008.

(51) Int. Cl.
*G08B 13/14* (2006.01)

(52) U.S. Cl. ..... 340/572.7

(58) Field of Classification Search ..... 340/572.7, 340/572.1–572.6; 343/700 R
See application file for complete search history.

(56) References Cited

U.S. PATENT DOCUMENTS

| | | | | |
|---|---|---|---|---|
| 7,535,424 | B2 * | 5/2009 | Henty | 343/702 |
| 7,663,544 | B2 * | 2/2010 | Thomas et al. | 342/361 |
| 7,688,267 | B2 * | 3/2010 | Hill | 343/702 |
| 7,873,385 | B2 * | 1/2011 | Boireau et al. | 455/553.1 |
| 2006/0043199 | A1 | 3/2006 | Baba et al. | |
| 2006/0174257 | A1 | 8/2006 | Arneson et al. | |
| 2006/0273905 | A1 | 12/2006 | Choi et al. | |
| 2007/0152830 | A1 | 7/2007 | Burr | |

OTHER PUBLICATIONS

"The RFID Tag Antenna: Orientation Sensitivity," Impinj RFID Technology Series, www.impinj.com, 2005, 2 pages.
"Two RF Inputs Make a Better RFID Tag," Technical White Paper, Symbol—The Enterprise Mobility Company, May 2006, 2 pages.
Collins, J. "Smart Soccer Ball Misses Its Goal," http://www.rfidjournal.com/article/print/2029, RFID Journal, Dec. 5, 2005, 2 pages.
Dietrich et al. "Spatial, Polarization, and Pattern Diversity for Wireless Handheldd Terminals," IEEE Transactions on Antennas and Propagation, vol. 49, No. 9, Sep. 2001, pp. 1271-1281.

* cited by examiner

*Primary Examiner* — Phung Nguyen
(74) *Attorney, Agent, or Firm* — Perkins Coie LLP

(57) ABSTRACT

Spatial antenna diversity is used with RFID tags to reduce sensitivity to multi-path fading. RFID tags can use a single multi-port chip or multiple multi-port chips. The ports of the chip or chips are coupled to separated feedpoints on one or more antennas.

31 Claims, 7 Drawing Sheets

RFID TAGS WITH ENHANCED RANGE AND BANDWIDTH OBTAINED BY SPATIAL ANTENNA DIVERSITY

CROSS REFERENCES

This application claims the benefit of U.S. Provisional application No. 61/033,313, entitled "RFID TAGS WITH ENHANCED RANGE AND BANDWIDTH OBTAINED BY SPATIAL ANTENNA DIVERSITY", filed Mar. 3, 2008, and is hereby incorporated by reference.

BACKGROUND

In a typical environment where RFID tags are used, RF signals transmitted by an RFID reader may take multiple paths to reach an RFID tag's antenna due to reflections of the RF waves from various objects in the propagation path, such as floors, ceilings, and walls. Due to constructive and destructive interference among the RF waves traveling different paths, electromagnetic standing wave patterns may be established. The standing wave patterns have periodic peaks and nulls that are located one quarter wavelength apart. An RFID tag's antenna essentially samples the RF field at its feedpoint. Consequently, if the RFID tag's antenna feedpoint is located at a null of the standing wave pattern, the tag will not receive the RFID reader's RF transmission and will not be powered up.

Diversity in antenna configurations, including spatial diversity, polarization diversity, pattern diversity, time diversity, and frequency diversity, has been explored in handheld radio systems, such as cellular phone systems, where both the transmitter and receiver are active devices. Diversity and/or an increase in signal power is used to provide better reliability in RF propagation environments where multipath fading can occur.

It should be noted that RFID tags are regulated by Gen 2 protocol standards and thus are not permitted to exploit signal processing to improve RF signal transmission reliability. Thus, there is a need for a system that overcomes the multipath fading problem, as well as providing additional benefits, for a passive RFID tag responding to an RFID reader's RF transmissions. Overall, the above examples of some related systems and associated limitations are intended to be illustrative and not exclusive. Other limitations of existing or prior systems will become apparent to those of skill in the art upon reading the following Detailed Description.

DETAILED DESCRIPTION

Described in detail below is a method of using spatial antenna diversity to reduce RFID tag sensitivity to multi-path fading and sensitivity to "hot" or "cold" spots on boxes or pallets. "Hot" spots are locations where the electric field strength generated by an incoming electromagnetic wave is high, and "cold" spots are locations where the strength is low. The differences in electromagnetic field strength are due to material properties of objects within the box or pallet.

Various aspects of the invention will now be described. The following description provides specific details for a thorough understanding and enabling description of these examples. One skilled in the art will understand, however, that the invention may be practiced without many of these details. Additionally, some well-known structures or functions may not be shown or described in detail, so as to avoid unnecessarily obscuring the relevant description.

The terminology used in the description presented below is intended to be interpreted in its broadest reasonable manner, even though it is being used in conjunction with a detailed description of certain specific examples of the invention. Certain terms may even be emphasized below; however, any terminology intended to be interpreted in any restricted manner will be overtly and specifically defined as such in this Detailed Description section.

Figure 1:
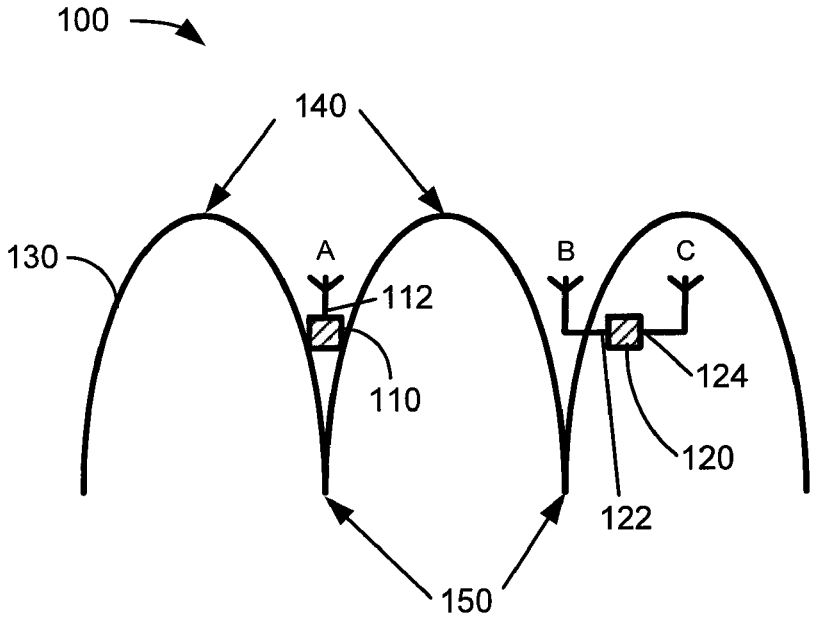
FIG. 1 shows an example of how an RFID tag with spatially separated antennas is resistant to fading effects.

An RFID reader transmits electromagnetic waves at radio frequencies. RFID tags may often receive the RF waves that have been reflected off other surfaces in the environment, such as floors, ceilings, walls, and shelves. In a typical propagation environment, standing wave patterns may be formed due to these reflections, and peaks and nulls located one quarter wavelength apart are established. In FIG. 1, an example 100 of the effect of a standing wave pattern on RFID tags 110, 120 is shown. The standing wave pattern 130 indicates the RFID reader signal strength in space. The RF signal is at a maximum at the peaks 140 and is at a minimum at the nulls 150. The RF signal strength at or near a null is insufficient to power an RFID tag. Neighboring peaks 140 are separated by one-half wavelength. Neighboring nulls 150 are, likewise, separated by one-half wavelength. The wavelength is determined by the wavelength at which the RFID reader transmits RF signals, typically between 800 MHz and 1000 MHz.

A feedpoint is the point that a signal appears to emanate from when an antenna is connected to a transmitter emitting a sinusoidal wave and viewed from the far field. If an RFID tag 110 has a single antenna whose feedpoint 112 is located at a null 150 of the RFID reader signal, no transfer of power from the RFID reader signal to the RFID tag will occur. In contrast, if an RFID tag 120 has two antennas 122, 124 that are separated by one-quarter wavelength, and if one of the antennas has a feedpoint 122 located at a null 150 of the RFID reader signal, the feedpoint of the other antenna 124 will be located at a peak 140 of the reader signal. Thus, a transfer of power from the RFID reader signal to the RFID tag will still occur through antenna 124.

The example depicted in FIG. 1 is for the case where one of the RFID tag's antennas 122 is situated at a null 150. Alternatively, the tag's antenna may not be situated at a null 150 but near the null where the RFID reader signal strength may still not be strong enough to power the RFID tag. In this case, the tag's second antenna will not be situated at a peak 150 but near the peak. However, the combined power received at the two antennas 122, 124 is sufficient to power the RFID tag 120.

Figure 2:
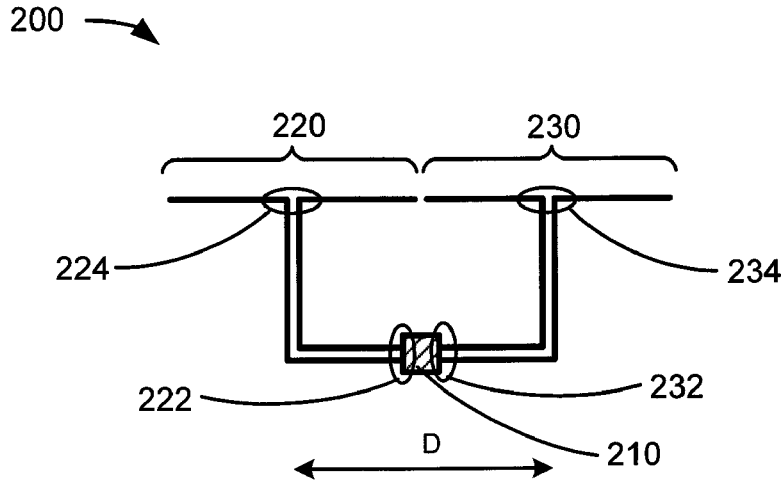
FIG. 2 shows an example of an RFID tag with a two-port integrated chip having two co-polarized, spatially separated antenna feedpoints.

An example of an RFID tag 200 having spatial diversity is shown in FIG. 2. The RFID tag 200 has a two-port RFID integrated circuit chip 210. A first dipole antenna 220 is coupled to the first port 222 of the RFID chip 210, and a second dipole antenna 230 is coupled to the second port 232 of the RFID chip 210. Note that the first antenna 220 and the second antenna 230 are co-polarized, that is, the antennas are parallel to each other. The first antenna 220 has a feedpoint at 224, and the second antenna 230 has a feedpoint at 234. The distance between the feedpoints 224 and 234 is D. In a depicted embodiment, the distance D is approximately one-quarter wavelength. However, any separation between the feedpoints of two antennas may improve the performance of the RFID tag by reducing the RFID tag's sensitivity to multipath fading and/or increasing the read range of the RFID tag.

Two-port RFID integrated circuit chips designed for use with RFID tags are well-known in the art for implementing polarization diversity. For example, Impinj, Inc. manufactures two-port RFID integrated circuit chips for RFID tags. Both Impinj, Inc. and Motorola, Inc., formerly Symbol Technologies, Inc., another RFID tag manufacturer, specifically recommend using diversity polarization, where two orthogonally oriented dipole antennas are used, with one antenna coupled to each of the two ports of the IC chip. Because a dipole antenna has a null parallel to the axis of the dipole, a dipole antenna is not able to receive any electromagnetic energy that is polarized parallel to the axis of the dipole. Thus, Impinj and Symbol Technologies teach using a two-port RFID chip only with diversity polarization to eliminate the problem of antenna nulls such that an RFID tag is able to receive RF signals polarized in any direction.

Figure 3A:
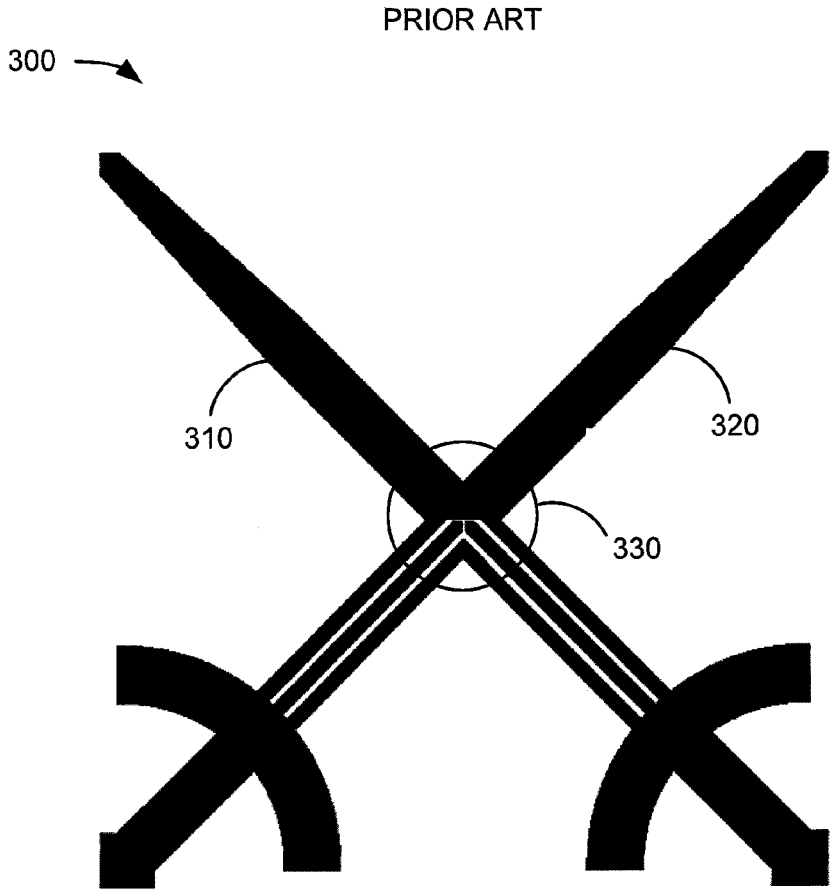
FIG. 3 shows two examples of prior art antenna configurations used with RFID tags, each using a two-port RFID chip.

FIG. 3A shows an example of an RFID tag with diversity polarization 300 having two cross-polarized antennas 310, 320 connected to a two-port RFID chip. The RFID tag 300 and two-port chip are manufactured by KSW Microtec AG and Impinj, Inc., respectively. In this configuration, one antenna is coupled to each one of the ports of the chip, but the feedpoints of the antennas are at the same location 330. Although the cross-polarized antenna configuration is able to receive RF signals polarized in any direction, using diversity polarization does not eliminate the problem presented by an RFID tag's feedpoints being located within a null of an RF standing wave. Thus, if the feedpoints 330 are located at a null, for example, point 150 in FIG. 1, the total power received by the cross-polarized antennas will still be insufficient to power the RFID tag.

Figure 3B:
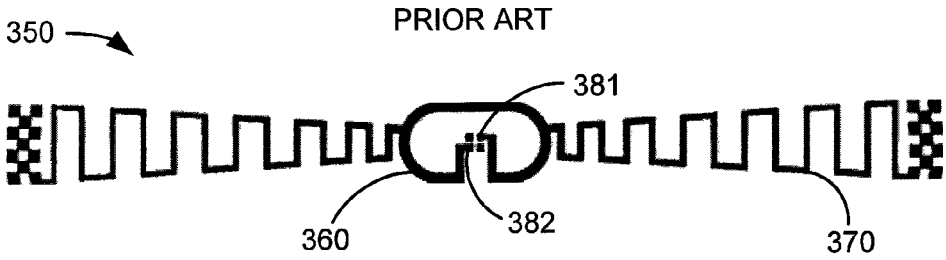

Moreover, because the footprint of the RFID tag having cross-polarized antennas 300 is so large, one port of the RFID chip is typically left unused. FIG. 3B shows an example of an RFID tag 350. The tag antenna 370 is manufactured by RSI ID Technologies, and the two-port RFID chip 360 is manufactured by Impinj, Inc. The RFID chip 360 has four contact pads corresponding to the two ports. Only the two contact pads 381, 382 corresponding to one port of the chip 360 are attached to the linearly polarized antenna 370. Thus, 50% of the RFID chip's capabilities are unused. However, the area occupied by an RFID tag having only one linearly polarized antenna 350 is significantly reduced from that of an RFID tag having the cross-polarized antenna configuration 300.

Note that if the two terminal ports of a two-port RFID chip are connected together with a conducting trace such that the two terminals are short circuited, the result is that the RFID chip does not perform as well as when only one port of the chip is used to couple to a feedpoint of the RFID tag's antenna. Thus, if only one port of a two-port RFID chip is coupled to an antenna, the other port should be left unconnected.

In contrast to polarization diversity, the key to spatial diversity, using co-polarized or orthogonally polarized antennas, is that the feedpoints of the antennas must be spatially separated. Several embodiments of antenna spatial diversity are shown in FIGS. 4A through 4K with multiple spatially separated multi-port RFID chips that share a single antenna or a single multi-port chip with distinct feed points.

Figure 4A:
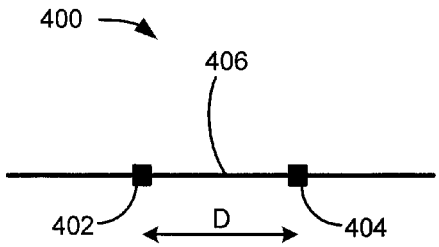
FIGS. 4A through 4K show several example embodiments of RFID tags with spatial diversity using multiple RFID integrated chips with either single or multiple ports or a single RFID chip with multiple ports.

FIG. 4A shows a first example of spatial diversity 400 using two one-port RFID chips 402, 404. A shared antenna 406 is coupled to both of the one-port RFID chips 402, 404. The RFID chips 402, 404 are physically separated by a distance D so that the feedpoints of the shared antenna 406 are separated by a distance D.

Figure 4B:
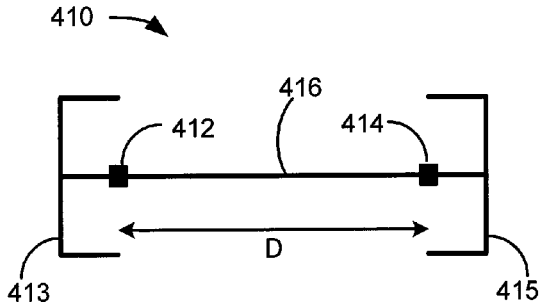

FIG. 4B shows a second example of spatial diversity 410 using two one-port RFID chips 412, 414. Similar to the above example 400, a shared antenna 416 is coupled to both of the RFID chips 412, 414. Again, the RFID chips 402, 404 are physically separated by a distance D so that the feedpoints of the shared antenna 406 are separated by a distance D. In this example, the portions of the antennas not shared by the ports 412, 414 take the form of stub elements 413, 415.

Figure 4C:
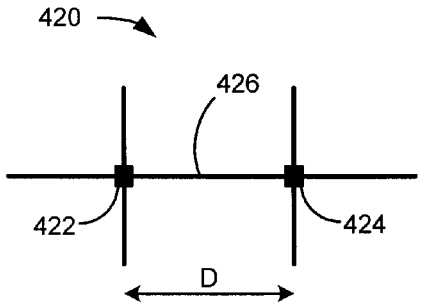

FIG. 4C shows a third example of spatial diversity 420 using two two-port RFID chips 422, 424. Both ports of the RFID chips 422, 424 are coupled to antennas. One antenna 426 is shared between the two RFID chips 422, 424. The two-port RFID chips 422, 424 are physically separated by a distance D so that the feedpoints of the shared antenna 426 are separated by a distance D. Each of the RFID chips 422, 424 has two cross-polarized antennas coupled to the ports.

Figure 4D:
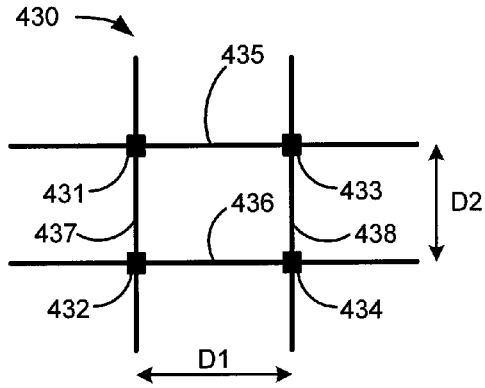

FIG. 4D shows a fourth example of spatial diversity 430 using four two-port RFID chips 431, 432, 433, 434. Each of the two-port RFID chips 431, 432, 433, 434 has two ports which yields a total of eight ports. All eight ports are coupled to antennas. A first shared antenna 435 is coupled to one of the ports on the RFID chip 431 and one of the ports on the RFID chip 433. A second shared antenna 436 is coupled to one of the ports on the RFID chip 432 and one of the ports on the RFID chip 434. RFID chips 431 and 433 are separated by a distance D1, and chips 432 and 434 are also separated by the distance D1. A third shared antenna 437 is coupled to one of the ports on the RFID chip 431 and one of the ports on the RFID chip 432. A fourth shared antennas 438 is coupled to one of the ports on the RFID chip 433 and one of the ports on the RFID chip 434. RFID chips 431 and 432 are separated by a distance D2, and chips 433 and 434 are also separated by the distance D2. Thus, the feedpoints of the shared antennas 435, 436 are separated by the distance D1, and the feedpoints of the shared antennas 437, 438 are separated by the distance D2.

Figure 4E:
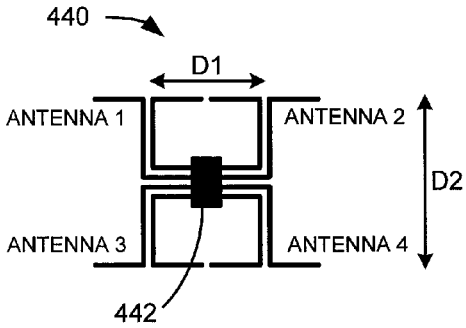

FIG. 4E shows a fifth example of spatial diversity 440 using one four-port RFID chip 440. All four antennas, antenna 1, antenna 2, antenna 3, and antenna 4 are co-polarized. The feedpoints of antenna 1 and antenna 2 as well as the feedpoints of antenna 3 and antenna 4 are separated by a distance D1, while the feedpoints of antenna 1 and antenna 3 as well as the feedpoints of antenna 2 and antenna 4 are separated by a distance D2.

In one embodiment, an RFID chip having more than two ports can be coupled to a shared antenna. Spatial diversity can be applied by designing the number of spatially separated feedpoints on the antenna to equal the number of ports, where the RF terminal of each port is coupled to a different feedpoint. In one embodiment, a shared dipole antenna can be bent at approximately a right angle. Thus, the antenna has two arms, one on each side of the right angle. For spatial diversity to be applied effectively, there should be at least two distinct feedpoints on each arm of the antenna. In this configuration, the antenna can receive power from two different field orientations.

Figure 4F:
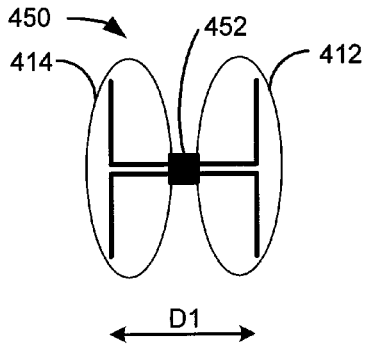

FIG. 4F shows a sixth example of spatial diversity 450 using one two-port RFID chip 452. The two antennas 412, 414 are co-polarized, and the feedpoints of the antennas 412, 414 are separated by a distance D1.

Figure 4G:
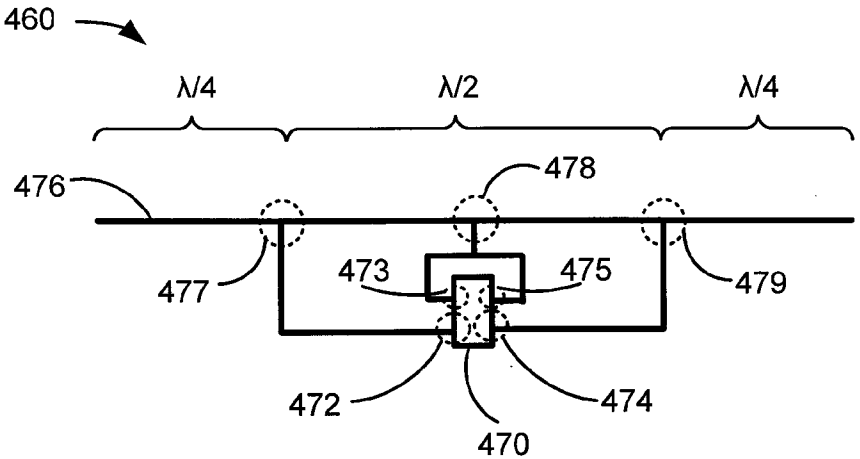

FIG. 4G shows an embodiment of a spatially diverse antenna configuration 460 for an RFID tag using a single two-port RFID chip 470 and a single shared linear dipole antenna 476 that is approximately one wavelength long. The two-port RFID chip 470 has two ports, and each port has two terminals. The first port has a first RF terminal 472 and a first ground terminal 473, and the second port has a second RF terminal 474 and a second ground terminal 475. The first and second ground terminals 473, 475 are both connected by conductive traces to approximately the midpoint 478 of the shared dipole antenna 476. The first RF terminal 472 is connected by a conductive trace to a feedpoint 477 on the dipole antenna 476 approximately one-quarter wavelength from the left end of the dipole antenna 476. The second RF terminal 474 is connected by a conductive trace to a feedpoint 479 on the dipole antenna 476 approximately one-quarter wavelength from the right end of the dipole antenna 476. Thus, the distance between the feedpoints 477, 479 is approximately one half wavelength. For an RF frequency of 900 MHz, the wavelength is approximately one third of a meter. The trace width can vary between approximately 1 mm and 10 mm, and the details on how the trace is bent or connected can also vary.

In the antenna configuration 460, the current distribution in the antenna 476 approximates a sine wave having a period of approximately one wavelength. The two ground terminals 473, 475 of the RFID chip 470 are coupled to the dipole antenna 476 at approximately the midpoint 478 because the current at or near the midpoint 478 is zero or close to zero. The two RF terminals 472, 474 of the RFID chip 470 are coupled to the feedpoints 477, 479 of the dipole antenna 476 because the current at the points located approximately one-quarter wavelength from each end of the dipole antenna 476 is a maximum.

Because the two ports of the RFID chip 470 are both coupled to one shared linear dipole antenna 476 at two separate feedpoints 477, 479, spatial diversity is advantageously achieved. The antenna configuration 460 will be less sensitive to the peaks and nulls of the RF signal due to multipath fading and also less sensitive to "hot" or "cold" spot locations on boxes or pallets. And significantly, the area occupied by the shared dipole antenna 476 is approximately equal to the area occupied by a single dipole antenna coupled to only one port of a two-port RFID chip 470.

Figure 4H:
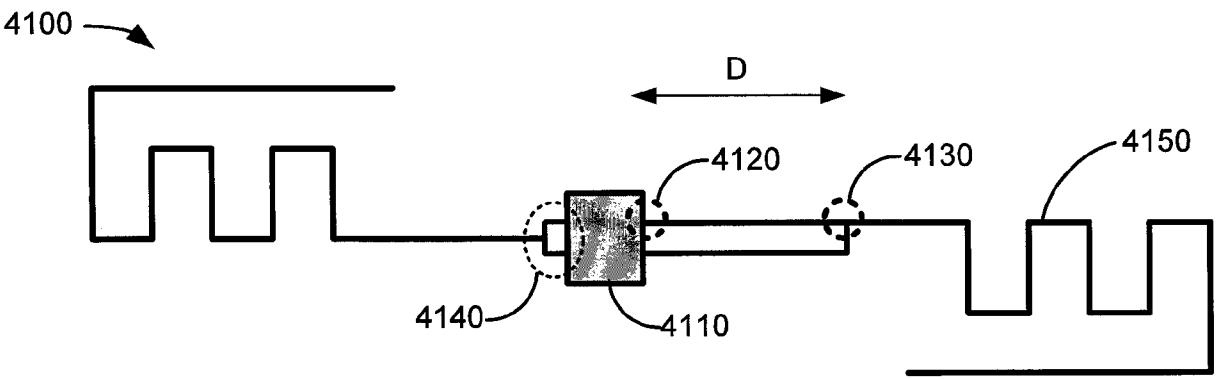

FIG. 4H shows an example of a spatially diverse antenna configuration 4100 for an RFID tag that illustrates that an arbitrary shared antenna 4150 may be used; the shared antenna need not be a dipole antenna. RFID chip 4110 has two ports, and each port has two terminals. The ground terminals 4140 of the two ports are connected together to a common ground. The RF terminal of one of the ports is coupled to a first feedpoint 4120 on the shared antenna 4150, and the RF terminal of the other port is connected by a conductive trace to a second feedpoint 4130 on the shared antenna 4150. The feedpoints 4120, 4130 are separated by a distance D. The distance D may range from zero to one half wavelength.

Figure 4I:
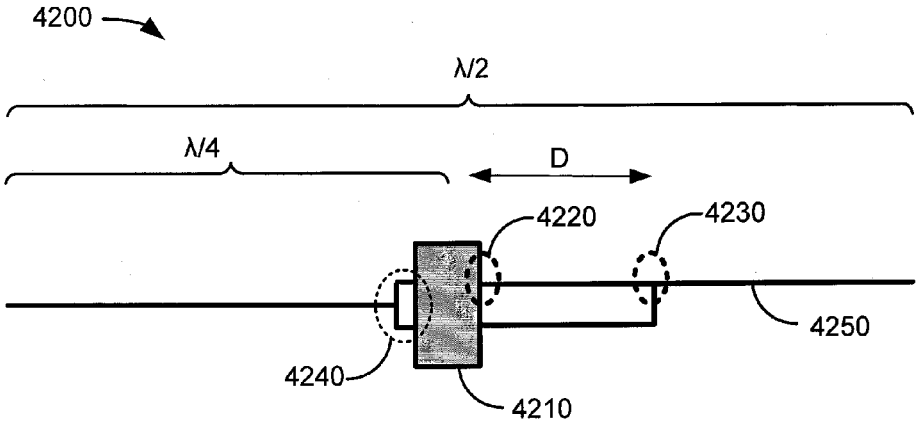
Figure 6:
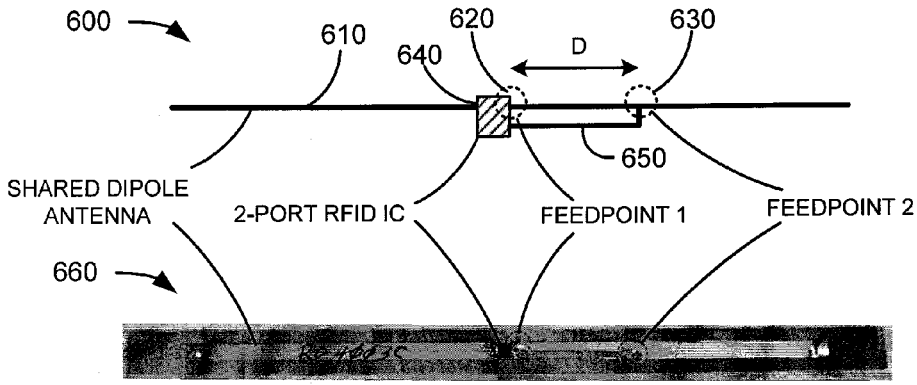
FIG. 6 shows a photograph of a prototype RFID tag with spatial diversity and a corresponding schematic diagram.

FIG. 4I shows another example of a spatially diverse antenna configuration 4200 for an RFID tag with shared antenna 4250. RFID chip 4210 has two ports, and each port has two terminals. The ground terminals 4240 of the two ports are connected together to a common ground. The RF terminal of one of the ports is coupled to a first feedpoint 4220 on the shared antenna 4250, and the RF terminal of the other port is connected by a conductive trace to a second feedpoint 4230 on the shared antenna 4250. The feedpoints 4220, 4230 are separated by a distance D. The total length of the shared antenna 4250 is approximately one half wavelength, the portion of the shared antenna to the left of the RFID chip 4210 is approximately one-quarter wavelength, and the distance D between the feedpoints 4220, 4230 may range from zero to one-quarter wavelength. A prototype based upon configuration 4200 is shown in FIG. 6, where the distance D is approximately one-twelfth of a wavelength.

Figure 4J:
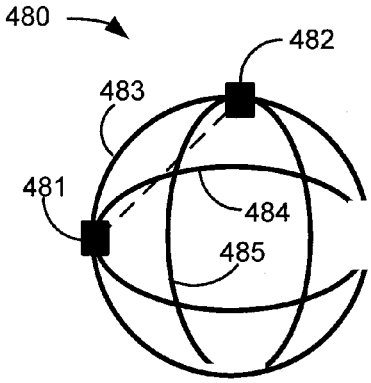
Figure 4K:
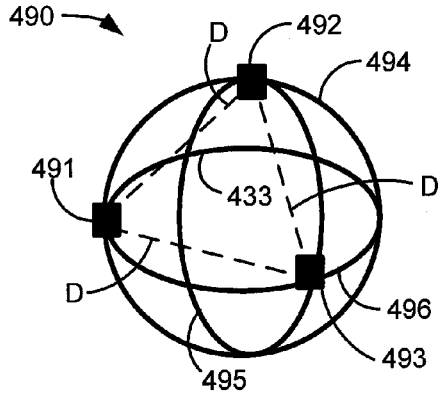

FIGS. 4J and 4K show examples of spatial diversity using three-dimensional antenna configurations formed on a sphere as represented on paper. FIG. 4J shows an example of spatial diversity 480 using two two-port RFID chips 481, 482 with a three-dimensional antenna configuration. There are three orthogonally curved dipole antennas 483, 484, 485; antennas 483, 484 are coupled to RFID chip 481, and antennas 483, 485 are coupled to RFID chip 482. The curved dipole antenna 483 is shared and coupled to both RFID chip 481 and 482. The RFID chips 481, 482 are physically separated by a distance D so that the feedpoints of the shared antenna 483 is separated by a distance D.

FIG. 4K shows an example of spatial diversity 490 using three two-port RFID chips 491, 492, 493 with a three-dimensional antenna configuration. Three mutually orthogonal loop antennas 494, 495, 496 are shared and coupled to the three RFID chips 491, 492, 493. The RFID chips 491, 492, 493 are each located a distance D from the other RFID chips. Loop 494 is coupled to RFID chips 491, 492; loop 495 is coupled to RFID chips 492, 493; and loop 496 is coupled to RFID chips 491, 493. Thus, the feedpoints of the shared antennas are separated by a distance D.

Examples 480 and 490 are considered omni-directional antennas because an RFID tag having one of these antenna configurations will receive and be powered-up from RF signals transmitted by an RFID reader from any direction with any polarization. However, because the antenna configurations are three-dimensional, an RFID tag having an omni-directional antenna 480, 490 would ideally be attached to a spherical package. Suitable dimensions for the radius of the spherical package would be on the order of $\lambda/(2\pi)$, where $\lambda$ is the wavelength of the RF signal. No protocols on the RFID chip need to be changed to implement the invention. Only software used by an RFID reader must be modified to recognize that RFID chips 481, 482 are part of a single tag 480 and a single object rather than identifying two different RFID tagged objects. Similar modifications are also needed for the tag example 490.

It should be noted that a shared antenna does not necessarily have to take the form of a dipole antenna. The shared antenna may be a loop antenna, a slot antenna, or a combination of dipole, loop, and/or slot antennas with variations such as folding or meandering. Thus, a shared antenna is not limited to any particular configuration.

Figure 5:
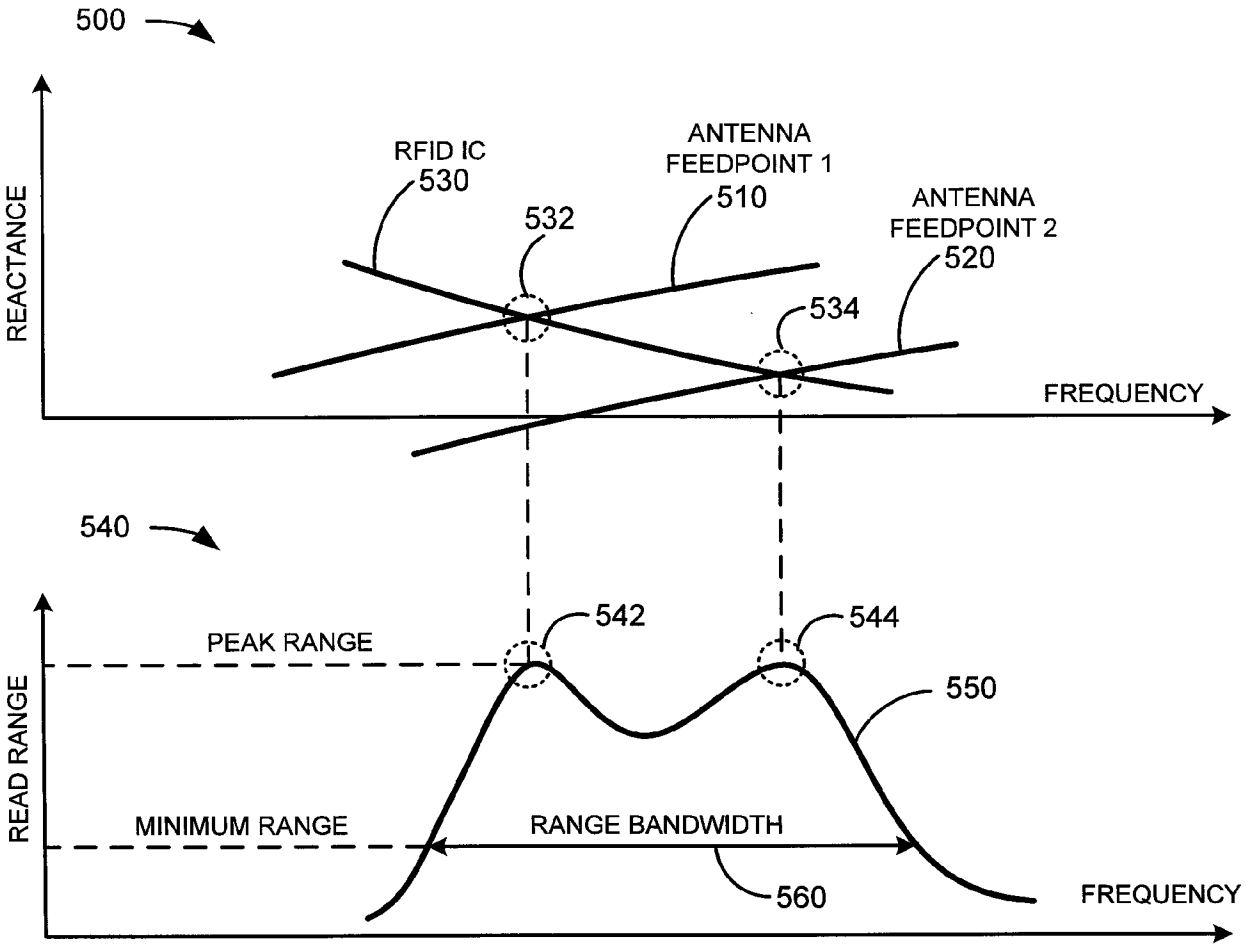
FIG. 5 shows two graphs. The top graph shows reactance curves as a function of frequency for an RFID tag's integrated circuit chip, with an antenna at a first feedpoint and an antenna at a second feedpoint. A corresponding graph of read range for the RFID tag as a function of frequency is shown in the bottom graph.

Spatially separated antenna feedpoints may also enhance an RFID tag's bandwidth because the separate antenna feedpoints each experience different impedances. For example, the upper graph 500 shown in FIG. 5 shows reactance curves as a function of frequency for a first antenna feedpoint 510, a second antenna feedpoint 520, and an RFID integrated circuit chip 530. Impedance matching occurs at the frequency that the RFID chip's reactance curve 530 crosses the reactance curve for each of the antenna feedpoints 510, 520. Because the reactance curves for the first and second antenna feedpoints 510, 520 are not identical, the RFID chip is impedance matched to the feedpoints 510, 520 at different frequencies. In particular, impedance matching between the RFID chip and the first antenna feedpoint occurs at the point on the curves labeled 532, and impedance matching between the RFID chip and the second antenna feedpoint occurs at the point on the curves labeled 534. The point 534 is at a higher frequency than the point 532.

When the RFID chip's reactance curve is impedance matched to an antenna feedpoint's reactance curve, a tag resonance occurs. A tag resonance is identifiable by a local maximum in the read range of the RFID tag. This means that when the RFID reader transmits RF signals at the tag's resonant frequency, the RFID tag can be powered by the RFID reader's signal at a farther distance from the RFID reader than when the RFID reader transmits an RF signal at a frequency removed from the tag's resonant frequency.

Typically, as with the example 350 of a tag with one linearly polarized antenna coupled to one port at one feedpoint, only one resonant tag frequency exists. However, when spatial diversity is used with RFID tags, at least two or more separate antenna feedpoints are present, resulting in two or more tag resonances. The lower graph 540 shown in FIG. 5 shows an example read range curve 550 as a function of frequency corresponding to the example reactance curves in the upper graph 500 in FIG. 5. The impedance matched point 532 in the upper graph 500 results in a tag resonance at point 542 in the lower graph 540, while the impedance matched point 542 results in a tag resonance at point 544.

Typically, the RFID tag's bandwidth is the difference between the two RFID reader transmission frequencies that result in read ranges of the RFID tag at half of the read range of the RFID tag at its resonant frequency. It will be apparent to a person skilled in the art that other definitions may also be used for determining a tag's bandwidth. When there are two resonant frequencies located sufficiently close together in frequency, the bandwidth 560 of the RFID tag is widened. Consequently, the RFID tag is responsive to a wider range of RFID reader transmission frequencies at a minimum read range distance. The minimum read range may depend on the particular requirements of an application.

Further, an RFID tag's bandwidth may be tailored by selecting the impedances of the feedpoints. Many methods may be used to change the impedance of the feedpoints, including but not limited to, varying the thickness of the conductive trace between the port of the RFID chip and the antenna feedpoint, adding meandering elements in the conductive trace between the port of the RFID chip and the antenna feedpoint, and changing the dielectric material on which the RFID tag is situated.

FIG. 6 shows a photograph of a prototype RFID tag 660 and a corresponding schematic 600 of its antenna configuration. The RFID tag 600 has one shared linear dipole antenna 610 coupled at two separate feedpoints 620, 630 to a two-port RFID chip 640. The feedpoints 620, 630 are separated by a distance D using a conducting trace 650 parallel to the shared dipole antenna 610. The distance D is 25 mm, or approximately one-twelfth of a wavelength. In the photograph 660, the conducting trace 650 is thinner than the width of the antenna 610.

Figure 7:
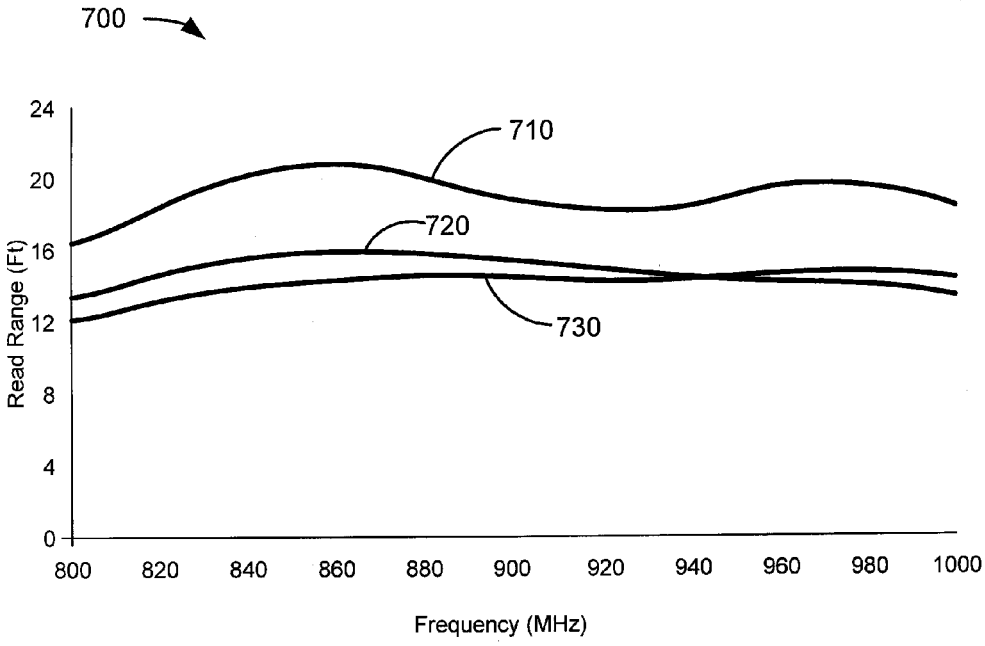
FIG. 7 is a graph of read range as a function of frequency comparing performance of an RFID tag with antenna spatial diversity and without antenna spatial diversity.

The prototype's performance was measured, and the read range of the RFID tag 660 as a function of frequency is shown in graph 700 in FIG. 7. Curve 720 shows the read range for the RFID tag 660 when the antenna 610 was driven only at feedpoint 620. Curve 730 shows the read range for the same RFID tag 660 when the antenna was 610 driven only at feedpoint 630. For both curves, the antenna was driven with the same amount of incident RF power. The performance of the antenna is similar in both situations, and the shifted tag resonance is visible. The tag resonance is at a different frequency for curve 730 than for curve 720, indicating that the impedances of the antennas at the feedpoints 620, 630 are different.

Curve 710 shows the read range performance for the RFID tag 660 when the antenna is driven at the two feedpoints 620, 630. The same amount of RF power used to drive the individual feedpoints resulting in the curves 720 and 730 is split between driving the feedpoints 620, 630. The result of driving the antenna at two spatially separated feedpoints 620, 630 is an approximately 25% increase in read range distance as well as broadening of the tag's bandwidth. Thus, using an RFID tag having a single two-port RFID chip with a single linear dipole antenna and separated feedpoints established through the use of an additional conductive trace significantly improves the performance of the RFID tag compared to using a standard single dipole tag similar to the example RFID tag 350 with a minimal increase in cost.

The words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while an RFID reader for reading RFID tags are mentioned, any reading apparatus for reading devices emitting radio-frequency signals may be used under the principles disclosed herein. Further any specific numbers noted herein are only examples: alternative implementations may employ differing values or ranges.

The teachings of the invention provided herein can be applied to other systems, not necessarily the system described above. The elements and acts of the various embodiments described above can be combined to provide further embodiments.

While the above description describes certain embodiments of the invention, and describes the best mode contemplated, no matter how detailed the above appears in text, the invention can be practiced in many ways. Details of the system may vary considerably in its implementation details, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

We claim:

1. An RFID tag comprising:

a dual-port RFID chip having a first port and a second port, wherein the first port has a first RF terminal and a first ground terminal, and the second port has a second RF terminal and a second ground terminal; and a shared antenna having a first feedpoint and a second feedpoint, wherein the first RF terminal couples to the first feedpoint located at a first point on the shared antenna, the second RF terminal couples to the second feedpoint at a second point a distance away from the first feedpoint on the shared antenna, and the first and second ground terminals couple to approximately a center point on the shared antenna, wherein a length of the shared antenna is approximately one wavelength, the first point is approximately one-quarter wavelength from a first end of the shared antenna, and the second point is approximately one-quarter wavelength from a second end of the shared antenna, and wherein the dual-port RFID chip and the shared antenna are configured for spatial antenna diversity and configured to reduce sensitivity to multi-path fading in response to a received wireless RFID signal.

2. The RFID tag of claim 1 wherein the shared antenna includes a dipole antenna having first and second portions coupled respectively to the first and second ports, and wherein first and second portions of the dipole antenna are coplanar and co-polarized.

3. The RFID tag of claim 1 wherein the shared antenna is selected from a group consisting of a dipole antenna, a loop antenna, a slot antenna, and a combination of dipole, loop, and/or slot antennas.

4. The RFID tag of claim 1 wherein the shared antenna is folded.

5. The RFID tag of claim 1 wherein the shared antenna includes meander elements or stub elements.

6. An RFID tag comprising:

at least one RFID chip having multiple ports, wherein each port has an RF terminal and a ground terminal; and at least one shared antenna having multiple feedpoints, wherein a total number of RF terminals equals a number of feedpoints on the shared antenna, each RF terminal is coupled to a different feedpoint, and each feedpoint is located at a different point on the antenna.

7. The RFID tag of claim 6 wherein the shared antenna is bent at substantially a right angle, having one arm on each side of the bend, and further wherein at least two feedpoints are located on each arm of the antenna.

8. The RFID tag of claim 6 wherein all the ground terminals are coupled to one point on the shared antenna.

9. The RFID tag of claim 6 wherein the shared antenna is selected from a group consisting of a dipole antenna, a loop antenna, a slot antenna, and a combination of dipole, loop, and/or slot antennas.

10. The RFID tag of claim 6 wherein the shared antenna is folded.

11. The RFID tag of claim 6 wherein the shared antenna includes meander elements or stub elements.

12. An RFID tag comprising:

an RFID chip having multiple ports, wherein each port has an RF terminal and a ground terminal; and multiple antennas each having at least one feedpoint, wherein each feedpoint is at a different location from all other feedpoints, and further wherein each RF terminal is coupled to one of the feedpoints.

13. The RFID tag of claim 12 wherein the multiple antennas include cross-polarized antennas.

14. The RFID tag of claim 12 wherein the multiple antennas are selected from a group consisting of a dipole antenna, a loop antenna, a slot antenna, and a combination of dipole, loop, and/or slot antennas.

15. The RFID tag of claim 12 wherein the multiple antennas are folded.

16. The RFID tag of claim 12 wherein the multiple antennas include meander elements or stub elements.

17. An RFID tag comprising:

multiple RFID chips, wherein each RFID chip has multiple ports, and each port has an RF antenna terminal and a ground terminal; and an antenna portion, wherein the antenna portion is either:

multiple antennas each having at least one feedpoint, wherein each feedpoint is at a different location from all other feedpoints, and further wherein each RF terminal is coupled to one of the feedpoints, or at least one shared antenna having at least two separated feedpoints, wherein at least two different RF terminals are coupled to the at least two separated feedpoints.

18. The RFID tag of claim 17 wherein the multiple RFID chips are arranged in a two-dimensional configuration.

19. The RFID tag of claim 17 wherein the multiple RFID chips are arranged in a three-dimensional configuration.

20. The RFID tag of claim 17 wherein the multiple antennas or the shared antenna are selected from a group consisting of a dipole antenna, a loop antenna, a slot antenna, and a combination of dipole, loop, and/or slot antennas.

21. The RFID tag of claim 17 wherein the multiple antennas or the shared antenna is folded.

22. The RFID tag of claim 17 wherein the multiple antennas or the shared antenna include meander elements or stub elements.

23. An RFID tag comprising:

an RFID chip having a frequency-dependent chip reactance; and a shared antenna having a plurality of feedpoints, wherein each feedpoint has a frequency-dependent feedpoint reactance, and the frequency-dependent chip reactance is substantially matched to each of the frequency-dependent feedpoint reactances at least one frequency.

24. The RFID tag of claim 23, wherein the shared antenna is selected from a group consisting of a dipole antenna, a loop antenna, a slot antenna, and a combination of dipole, loop, and/or slot antennas.

25. The RFID tag of claim 23, wherein the shared antenna is folded.

26. The RFID tag of claim 23, wherein the shared antenna includes meander elements or stub elements.

27. An RFID tag comprising:

a dual-port RFID chip having a first port and a second port, wherein the first port has a first RF terminal and a first ground terminal, and the second port has a second RF terminal and a second ground terminal; and a shared antenna having a first feedpoint and a second feedpoint, wherein the first RF terminal couples to the first feedpoint located at a first point on the shared antenna, the second RF terminal couples to the second feedpoint at a second point a distance away from the first feedpoint on the shared antenna, and the first and second ground terminals couple to approximately a center point on the shared antenna.

28. The RFID tag of claim 27, wherein the shared antenna includes a dipole antenna having first and second portions coupled respectively to the first and second ports, and wherein first and second portions of the dipole antenna are coplanar and co-polarized.

29. The RFID tag of claim 27, wherein the shared antenna is selected from a group consisting of a dipole antenna, a loop antenna, a slot antenna, and a combination of dipole, loop, and/or slot antennas.

30. The RFID tag of claim 27, wherein the shared antenna is folded.

31. The RFID tag of claim 27, wherein the shared antenna includes meander elements or stub elements.

* * * * *